US009232306B2

(12) United States Patent
Crosby et al.

(10) Patent No.: US 9,232,306 B2
(45) Date of Patent: Jan. 5, 2016

(54) SYSTEMS AND METHODS FOR REDUCING STRAY MAGNETIC FLUX

(71) Applicant: Apple Inc., Cupertino, CA (US)

(72) Inventors: Justin D. Crosby, Cupertino, CA (US); Derek J. Yap, San Carlos, CA (US); William F. Leggett, San Jose, CA (US)

(73) Assignee: Apple Inc., Cupertino, CA (US)

( * ) Notice: Subject to any disclaimer, the term of this patent is extended or adjusted under 35 U.S.C. 154(b) by 271 days.

(21) Appl. No.: 13/833,636

(22) Filed: Mar. 15, 2013

(65) Prior Publication Data

US 2013/0329910 A1 Dec. 12, 2013

Related U.S. Application Data

(60) Provisional application No. 61/657,885, filed on Jun. 10, 2012.

(51) Int. Cl.

| | |
|---|---|
| ***H04R 1/40*** | (2006.01) |
| ***H04R 3/00*** | (2006.01) |
| ***H04R 31/00*** | (2006.01) |
| ***H04R 5/02*** | (2006.01) |

(52) U.S. Cl.

CPC .. *H04R 3/00* (2013.01); *H04R 5/02* (2013.01); *H04R 31/00* (2013.01); *H04R 2209/022* (2013.01); *H04R 2499/15* (2013.01); *Y10T 29/49005* (2015.01)

(58) Field of Classification Search

None

See application file for complete search history.

(56) References Cited

U.S. PATENT DOCUMENTS

| | | | | |
|---|---|---|---|---|
| 4,426,553 | A * | 1/1984 | Senoo | 381/182 |
| 5,357,587 | A * | 10/1994 | Grodinsky et al. | 381/414 |
| 5,821,471 | A * | 10/1998 | McCuller | 181/156 |
| 6,430,010 | B1 | 8/2002 | Murdock | |
| 2006/0165251 | A1 | 7/2006 | Bank | |
| 2007/0263894 | A1 | 11/2007 | Stiles | |
| 2008/0205690 | A1 | 8/2008 | Danovi et al. | |
| 2009/0323994 | A1 | 12/2009 | Makela et al. | |
| 2011/0136546 | A1 | 6/2011 | Otsuki | |
| 2012/0070022 | A1 | 3/2012 | Saiki | |
| 2012/0263338 | A1 * | 10/2012 | Hori et al. | 381/398 |

FOREIGN PATENT DOCUMENTS

| | | |
|---|---|---|
| AU | 2011100424 | 6/2011 |
| JP | 61/255199 | 12/1986 |

(Continued)

OTHER PUBLICATIONS

Apple Inc., Korean Patent Application No. 10-2013-65740, Notice of Preliminary Rejection dated Jul. 1, 2014, 5 pages.

(Continued)

*Primary Examiner* — Thang Tran

(74) *Attorney, Agent, or Firm* — Blakely, Sokoloff, Taylor & Zafman LLP

(57) ABSTRACT

Systems and methods for reducing the effects of stray magnetic flux are provided. For example, an electronic device can employ the system and can include a first audio component configured to have a first acoustic phase and a first magnetic phase. The electronic device can also include a second audio component configured to have the first acoustic phase and a second magnetic phase that is opposite the first magnetic phase. The first audio component can be positioned with respect to the second audio component, such that any stray magnetic flux from the first audio component enters the second audio component during operation of the first and second audio components.

20 Claims, 4 Drawing Sheets

(56) References Cited

FOREIGN PATENT DOCUMENTS

| | | |
|---|---|---|
| JP | 2003-018682 | 1/2003 |
| JP | 2013/18682 | 1/2003 |
| JP | 2004/023749 | 1/2004 |
| JP | 2006252756 | 9/2006 |
| JP | 2007128939 | 5/2007 |
| TW | 446970 | 7/2007 |
| TW | 2008509803 | 2/2008 |
| TW | M430792 | 6/2012 |
| WO | WO-2010/041369 | 4/2010 |

OTHER PUBLICATIONS

Justin D. Crosby, et al., Office Action dated Jun. 3, 2014 for JP Application No. 2013-121629 titled "Systems and Methods for Reducing Stray Magnetic Flux".

Apple Inc., Notice of Preliminary Rejection mailed Apr. 8, 2015 for Korean Appln. No. 10-2013-65740.

Apple Inc., Final Rejection mailed Dec. 1, 2014 for Japanese Appln. No. 2013-121629.

Apple Inc., "Systems and Methods for Reducing Stray Magnetic Flux", AU Patent Application No. 2013205187, Patent Examination Report No. 1, mailed Jan. 30, 2015, 4 pages.

Apple Inc., "Systems and Methods for Reducing Stray Magnetic Flux", CA Application No. 2,817,598, Examiner's Report, (Jan. 29, 2015), 3 pages.

Apple Inc., "Systems and Methods for Reducing Stray Magnetic Flux", TW Applicaiton No. 102120576, Office Action mailed Feb. 13, 2015, 15 pages.

* cited by examiner

SYSTEMS AND METHODS FOR REDUCING STRAY MAGNETIC FLUX

FIELD OF THE INVENTION

This relates to systems and methods for reducing stray magnetic flux, and, more particularly, to systems and methods for reducing the effects of stray magnetic flux from a loudspeaker in an electronic device.

BACKGROUND OF THE INVENTION

As electronic devices and, more particularly, portable electronic devices (e.g., laptop computers, tablets, and cellular telephones) continue to get smaller, components of the devices continue to be positioned closer to one another. Certain device components, such as electrodynamic transducers (e.g., loudspeakers) often produce stray magnetic flux that is potentially disruptive to adjacent magnetically sensitive device components (e.g., Hall sensors and hard drives). If stray flux is not adequately kept away from certain magnetically sensitive components, those components may fail and/or cause damage to the electronic device. A traditional way to reduce such stray magnetic flux interference is to provide a shield about the component generating the stray magnetic flux and/or about the component to be protected from the stray magnetic flux. However, such a shield often takes up valuable real estate within a device.

SUMMARY OF THE INVENTION

Systems and methods for reducing stray magnetic flux in an electronic device are provided.

In at least one embodiment, an electronic device is provided. The electronic device can include a first audio component configured to have a first acoustic phase and a first magnetic phase, and a second audio component configured to have the first acoustic phase and a second magnetic phase that is opposite the first magnetic phase. The first audio component can be positioned with respect to the second audio component such that stray magnetic flux from the first audio component enters the second audio component during operation of the first and second audio components. For example, the stray magnetic flux can be encouraged to enter the second audio component and complete its flux loop.

In at least one embodiment, a method of manufacturing an electronic device is provided. The method can include positioning a first audio component within the electronic device. The first audio component can be positioned to provide a first acoustic phase and a first magnetic phase. The method can also include situating a second audio component within the electronic device. The second audio component can be situated to provide the first acoustic phase and a second magnetic phase opposite the first magnetic phase. The first and second audio components can also be oriented relative to one another such that the first and second magnetic phases cause stray magnetic flux from the first audio component to enter the second audio component during operation of the first and second audio components. For example, the stray magnetic flux can be encouraged to enter the second audio component and complete its flux loop.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION OF THE INVENTION

Systems and methods for reducing stray magnetic flux in an electronic device are provided and described with reference to FIGS. 1-6.

Figure 1:
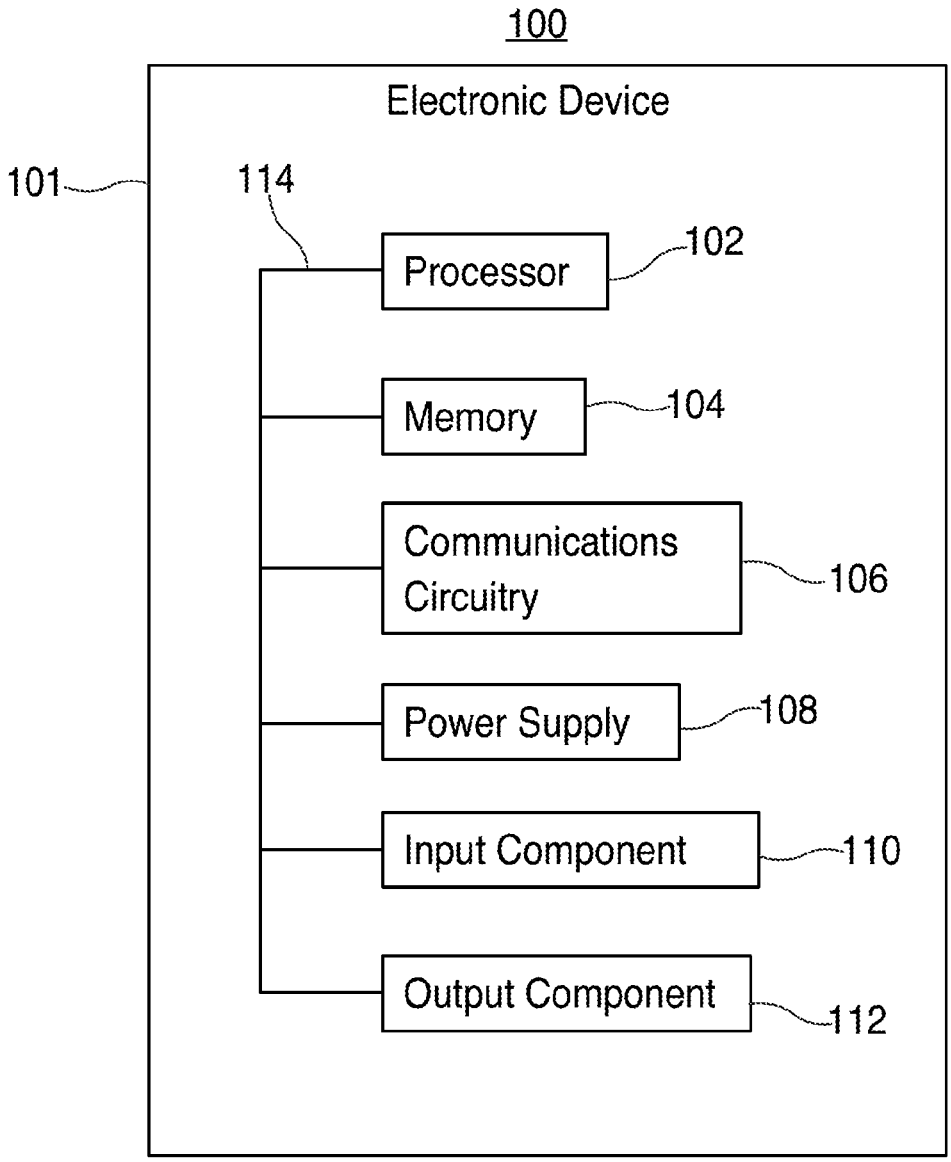
FIG. 1 is a simplified schematic diagram of an electronic device, in accordance with at least one embodiment of the invention.

FIG. 1 is a simplified schematic diagram of an electronic device 100 that may be configured to reduce stray magnetic flux or leakage flux. Electronic device 100 may be any portable, mobile, or hand-held electronic device. Alternatively, electronic device 100 may not be portable, but may instead be generally stationary. Electronic device 100 can include, but is not limited to, a music player (e.g., an iPod™ available by Apple Inc. of Cupertino, Calif.), video player, still image player, game player, other media player, music recorder, movie or video camera or recorder, still camera, other media recorder, radio, medical equipment, domestic appliance, transportation vehicle instrument, musical instrument, calculator, cellular telephone (e.g., an iPhone™ available by Apple Inc.), other wireless communication device, personal digital assistant, remote control, pager, desktop computer (e.g., an iMac™ available by Apple Inc. of Cupertino, Calif.), laptop computer (e.g., a MacBook™ available by Apple Inc. of Cupertino, Calif.), tablet (e.g., an iPad™ available by Apple Inc. of Cupertino, Calif.), server, monitor, television, stereo equipment, set up box, set-top box, boom box, modem, router, printer, and combinations thereof.

Electronic device 100 may include a processor or control circuitry 102, memory 104, communications circuitry 106, power supply 108, input component 110, and output component 112. Electronic device 100 may also include a bus 114 that may provide one or more wired or wireless communication links or paths for transferring data and/or power to, from, or between various other components of device 100. In some embodiments, one or more components of electronic device 100 may be combined or omitted. Moreover, electronic device 100 may include other components not combined or included in FIG. 1. For example, electronic device 100 may also include a compass, positioning circuitry, and/or several instances of one or more of the components shown in FIG. 1. For the sake of simplicity, only one of each of the components is shown in FIG. 1.

Memory 104 may include one or more storage mediums, including for example, a hard disk drive ("HDD"), flash memory, permanent memory such as read-only memory ("ROM"), semi-permanent memory such as random access memory ("RAM"), any other suitable type of storage component, or any combination thereof. Memory 104 may include cache memory, which may be one or more different types of memory used for temporarily storing data for electronic device applications. Memory 104 may store media data (e.g., music and image files), software (e.g., for implementing functions on device 100), firmware, preference information (e.g., media playback preferences), lifestyle information (e.g., food preferences), exercise information (e.g., information obtained by exercise monitoring equipment), transaction information (e.g., information such as credit card information), wireless connection information (e.g., information that may enable device 100 to establish a wireless connection), subscription information (e.g., information that keeps track of podcasts or television shows or other media a user subscribes to), contact information (e.g., telephone numbers and e-mail addresses), calendar information, any other suitable data, or any combination thereof.

Communications circuitry 106 may be provided to allow device 100 to communicate with one or more other electronic devices or servers using any suitable communications protocol. For example, communications circuitry 106 may support Wi-Fi (e.g., an 802.11 protocol), Ethernet, Bluetooth™, high frequency systems (e.g., 900 MHz, 2.4 GHz, and 5.6 GHz communication systems), infrared, transmission control protocol/internet protocol ("TCP/IP") (e.g., any of the protocols used in each of the TCP/IP layers), hypertext transfer protocol ("HTTP"), BitTorrent™, file transfer protocol ("FTP"), real-time transport protocol ("RTP"), real-time streaming protocol ("RTSP"), secure shell protocol ("SSH"), any other communications protocol, or any combination thereof. Communications circuitry 106 may also include circuitry that can enable device 100 to be electrically coupled to another device (e.g., a host computer or an accessory device) and communicate with that other device, either wirelessly or via a wired connection.

Power supply 108 may provide power to one or more of the components of device 100. In some embodiments, power supply 108 can be coupled to a power grid (e.g., when device 100 is not a portable device, such as a desktop computer). In some embodiments, power supply 108 can include one or more batteries for providing power (e.g., when device 100 is a portable device, such as a cellular telephone). As another example, power supply 108 can be configured to generate power from a natural source (e.g., solar power using solar cells).

One or more input components 110 may be provided to permit a user to interact or interface with device 100. For example, input component 110 can take a variety of forms, including, but not limited to, a touch pad, dial, click wheel, scroll wheel, touch screen, one or more buttons (e.g., a keyboard), mouse, joy stick, track ball, microphone, camera, proximity sensor, Hall effect sensor, light detector, motion sensor, and any combinations thereof. Each input component 110 can be configured to provide one or more dedicated control functions for making selections or issuing commands associated with operating device 100.

Electronic device 100 may also include one or more output components 112 that may present information (e.g., graphical, audible, and/or tactile information) to a user of device 100. For example, output component 112 can take a variety of forms, including, but not limited to, audio loudspeakers, headphones, signal lines-out, visual displays, antennas, infrared ports, rumblers, vibrators, and any combinations thereof.

It should be noted that one or more input components 110 and one or more output components 112 may sometimes be referred to collectively herein as an input/output ("I/O") component or I/O interface. For example, input component 110 and output component 112 may sometimes be a single I/O component, such as a touch screen, that may receive input information through a user's touch of a display screen and that may also provide visual information to a user via that same display screen.

Processor 102 of device 100 may include any processing circuitry operative to control the operations and performance of one or more components of electronic device 100. For example, processor 102 may be used to run operating system applications, firmware applications, graphics editing applications, media playback applications, media editing applications, or any other application. In some embodiments, processor 102 may receive input signals from input component 110 and/or drive output signals through output component 112. Processor 102 may load a user interface program (e.g., a program stored in memory 104 or another device or server accessible by device 100) to determine how instructions or data received via input component 110 may manipulate the way in which information is stored and/or provided to the user via output component 112.

Electronic device 100 may also be provided with a housing 101 that may at least partially enclose one or more of the components of device 100 for protection from debris and other degrading forces external to device 100. In some embodiments, housing 101 may include several walls that can define a cavity within which the various electronic components of device 100 can be disposed. In some embodiments, housing 101 can support various electronic components of device 100, such as one or more input/output ("I/O") components 110 and/or I/O components 112, at the surfaces or within openings through the surfaces of the walls of housing 101. In some embodiments, one or more of the components may be provided within its own housing component (e.g., input component 110 may be an independent keyboard or mouse within its own housing component that may wirelessly or through a wire communicate with processor 102, which may be provided within its own housing component). Housing 101 can be formed from a wide variety of materials including, but not limited to, metals (e.g., steel, copper, titanium, aluminum, and various metal alloys), ceramics, plastics, glass, and any combinations thereof. Housing 101 may also help to define the shape or form of electronic device 100. That is, the contour of housing 101 may embody the outward physical appearance of electronic device 100.

Figure 2:
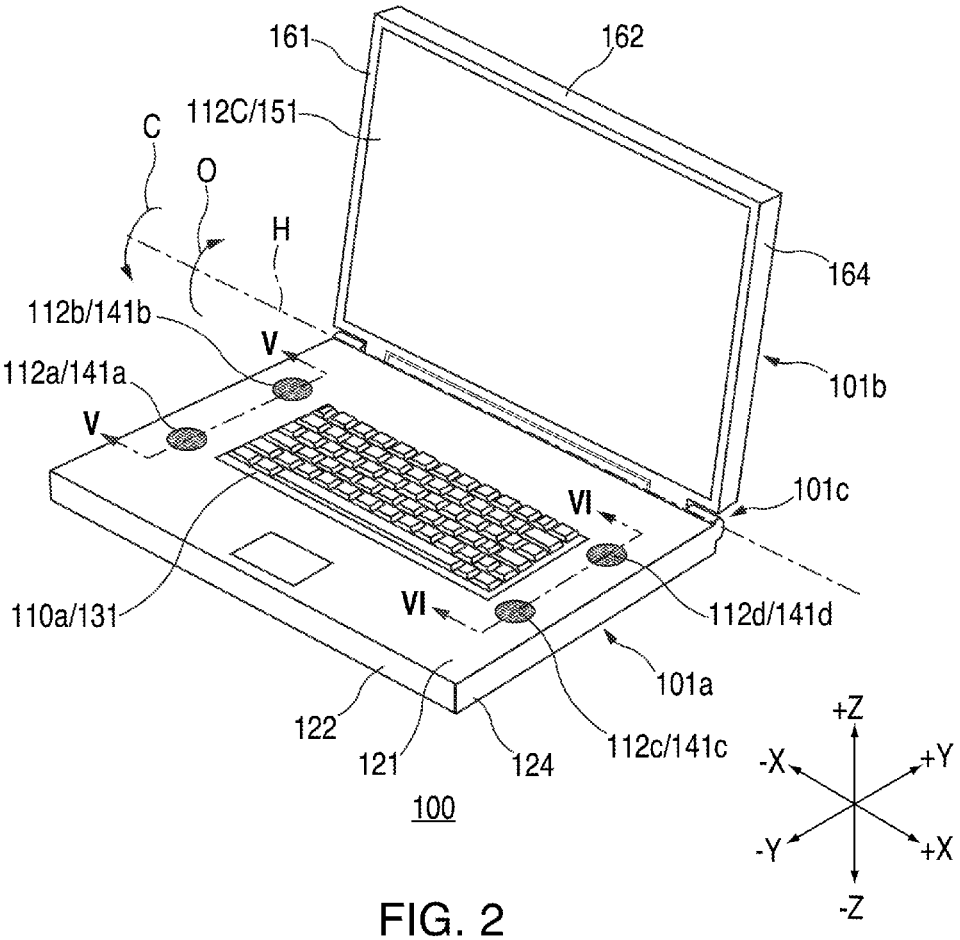
FIG. 2 shows a top, front, right perspective view of the electronic device of FIG. 1 in an open position, in accordance with at least one embodiment of the invention.
Figure 3:
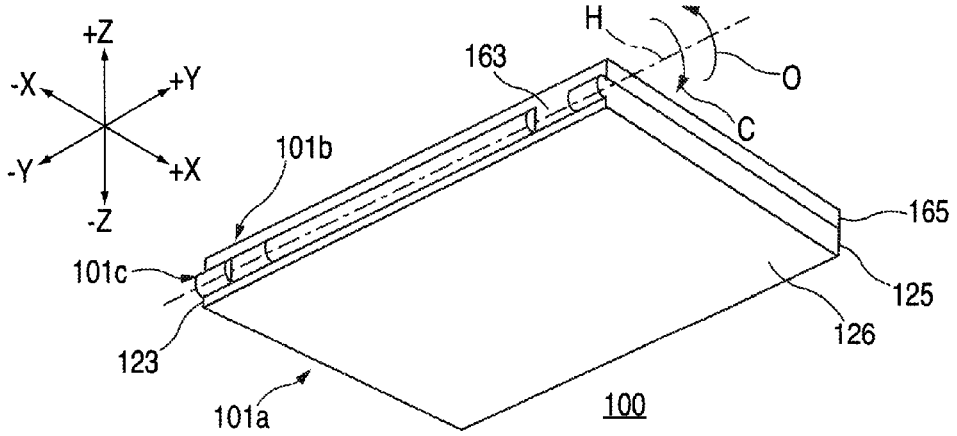
FIG. 3 shows a bottom, back, left perspective view of the electronic device of FIGS. 1 and 2 in a closed position, in accordance with at least one embodiment of the invention.

Electronic device 100 is illustrated in FIGS. 2 and 3 to be a laptop computer, although it is to be understood that electronic device 100 may be any type of electronic device as described herein. As shown in FIGS. 2 and 3, for example, housing 101 of electronic device 100 may be configured to provide two housing components coupled together by a hinge or clutch assembly. Particularly, housing 101 may include a base housing component 101*a* and a display housing component 101*b* coupled to one another by a hinge assembly 101*c*, which may also be known as clutch assembly 101*c*. Housing components 101*a*, 101*b*, and 101*c* may be configured such that electronic device 100 may be "opened" for use (see, e.g., FIG. 2) by rotating display housing component 101*b* away from base housing component 101*a* in the direction of arrow O about hinge axis H of hinge assembly 101*c*, and such that electronic device 100 may be "closed" (see, e.g., FIG. 3) by rotating display housing component 101*b* towards base housing component 101*a* in the direction of arrow C about hinge axis H. However, it should be noted that housing 101 of device 100 is only exemplary and need not include two substantially hexahedral portions coupled by a hinge. For example, in certain embodiments, the housing of device 100 could generally be formed in any other suitable shape, including, but not limited to, one or more housing components or portions that are substantially spherical, ellipsoidal, conoidal, octahedral, and any combinations thereof.

Base housing component 101*a* may include a top wall 121, a bottom wall 126 opposite top wall 121, and various side walls, such as front wall 122, back wall 123 opposite front wall 122, right wall 124, and left wall 125 opposite right wall 124. In some embodiments, one or more openings may be provided through one or more of the walls of housing component 101*a* to at least partially expose one or more components of electronic device 100. For example, as shown in FIG. 2, at least one opening 131 may be provided through top wall 121 of base housing component 101*a* to at least partially expose an input component 110*a* of electronic device 100. In some embodiments, as shown in FIG. 2 for example, openings 141*a*, 141*b*, 141*c*, and 141*d* may be provided through top wall 121 of base housing component 101*a* to at least partially expose respective output components 112*a*, 112*b*, 112*c*, and 112*d* of electronic device 100.

Likewise, display housing component 101*b* may include a top wall 161, a bottom wall (not shown) opposite top wall 161, and various side walls, such as front wall 162, back wall 163 opposite front wall 162, right wall 164, and left wall 165 opposite right wall 164. In some embodiments, one or more openings may be provided through one or more of the walls of housing component 101*b* to at least partially expose one or more components of electronic device 100. For example, as shown in FIG. 2, an opening 151 may be provided through top wall 161 of display housing component 101*b* to at least partially expose an output component 112*c* of electronic device 100.

Input component 110*a* is illustrated in FIG. 2 to be a keyboard, although it is to be understood that input component 110*a*, which may be exposed by opening 131 through top wall 121 of housing component 101*a*, may be any type of input component 110 as described herein. Moreover, although output components 112*a*, 112*b*, 112*c*, and 112*d* are illustrated in FIG. 2 to be audio loudspeakers, it is to be understood that each one of output components 112*a*, 112*b*, 112*c*, and 112*d*, which may be exposed by respective openings 141*a*-141*d* through top wall 121 of housing component 101*a*, may be any type of output component 112 as described herein. Similarly, although output component 112*c* is illustrated in FIG. 2 to be a visual display, it is to be understood that output component 112*c*, which may be exposed by opening 151 through top wall 161 of housing component 101*b*, also may be any type of output component 112 as described herein.

Figure 4:
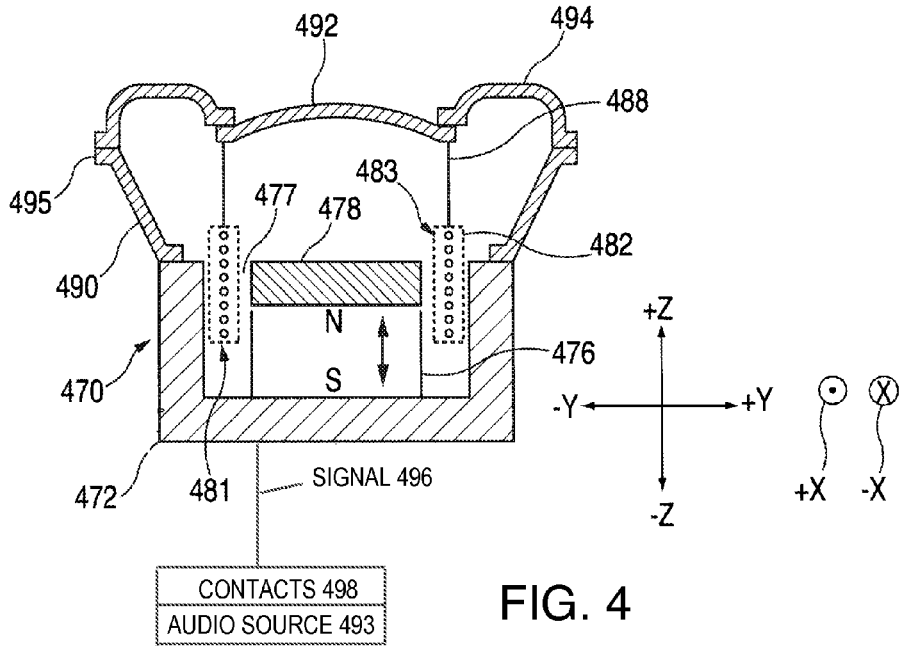
FIG. 4 shows a partial cross-sectional view of a loudspeaker assembly, in accordance with at least one embodiment of the invention.

FIG. 4 shows a detailed cross-sectional view of an exemplary audio loudspeaker assembly 412, which may be similar to one or more of audio loudspeakers 112*a*, 112*b*, 112*c*, and 112*d* of FIG. 2. As shown in FIG. 4, a magnetic air gap 477 may be formed between an under yoke 472 and a top plate 478, using a permanent magnet 476. Under yoke 472, permanent magnet 476, and top plate 478 may be collectively referred to herein as a magnet assembly 470.

An electrically conductive voice coil 482 may be wound about or otherwise coupled to a former 488. Coil 482 can be wound such that current flows in a +X-direction (e.g., out of the page) in portions 481 of coil 482, and flows in a −X-direction (e.g., into the page) in portions 483 of coil 482.

A frame 490 may be coupled to and may extend from magnet assembly 470. A diaphragm or cone 492 may extend from a top portion 495 of frame 490 to a top portion of former 488 about axis A. Surround 494 may serve to suspend and maintain cone 492 and former 488 centered about and aligned with respect to top plate 478, while also serving to allow axial movement along axis A of voice coil 482 and former 488 within magnetic air gap 477 of magnet assembly 470.

When an alternating current (e.g., an audio electrical signal provided by an audio source of device 100, such as an amplifier) is passed through voice coil 482 (e.g., as shown in FIG. 4), coil 482 can be subjected to a force due to a stationary magnetic field in gap 477. This is commonly referred to as the Lorentz force, and is the cross product of the stationary magnetic field in gap 477 and the current in coil 482. This force can alternate sign (or direction), depending on the direction of current in coil 482, and can displace cone 492 and surround 494 in the ±Z-directions to generate sound waves.

It is to be noted that, while loudspeakers may be shown in cross-section herein (e.g., because speakers may generally be cylindrically or rotationally symmetrical about an axis line or center line, such as axis A of FIG. 4), one skilled in the art may appreciate the three-dimensional structure of such loudspeakers and that one or more of the loudspeakers described herein may not necessarily be axially symmetric. Moreover, although FIG. 4 shows an axially symmetric loudspeaker having a magnet assembly disposed interior to coil 482, it should be appreciated that an axially symmetric loudspeaker can instead have a magnet assembly disposed exterior to coil 482.

Figure 5:
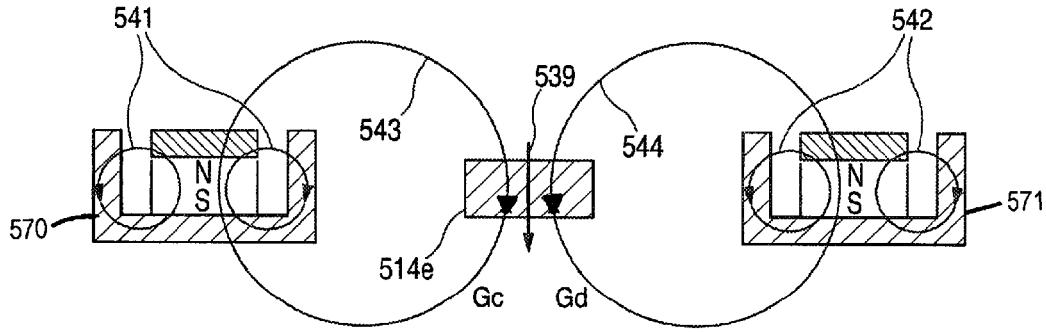
FIG. 5 shows a cross-sectional of a pair of adjacent magnet assemblies of corresponding loudspeakers, in accordance with at least one embodiment of the invention.

As described above, a device can include two or more output components or loudspeakers positioned adjacent one another. In typical devices, the magnet assembly of each of these loudspeakers can be similarly oriented, and can provide the same magnetic phase. FIG. 5 shows a cross-sectional of a pair of magnet assemblies 570 and 571 of corresponding loudspeakers (not shown) that can each be similar to magnet assembly 470. As shown in FIG. 5, magnet assembly 570 can be oriented to provide a magnetic flux path 541, and magnet assembly 571 can be oriented to provide a similar magnetic flux path 542 in the same magnetic phase as magnetic flux path 541. However, because the magnetic phases of magnetic flux paths 541 and 542 are the same, any magnetic flux that may stray from each flux path may form a self-closing flux loop with the respective magnet assembly. As shown in FIG. 5, for example, stray magnetic flux Gc may form a self-closing flux loop 543, and stray magnetic flux Gd may form a self-closing flux loop 544. Flux loops 543 and 544 may interfere with any component positioned between magnet assemblies 570 and 571 that may have its own magnetic flux. For example, as shown in FIG. 5, a magnetically sensitive input device component 514*e* may be positioned in between magnet assemblies 570 and 571 in the same X-Y plane. In some embodiments, magnetically sensitive input component 514*e* may be a Hall effect sensor or any other suitable input component that may be affected by stray magnetic flux of another component. For example, as shown, magnetically sensitive input component 514*e* may have its own magnetic flux sensitivity direction 539 extending therethrough (e.g., in the −Z direction). The additional magnetic flux that may be added to flux 539 of magnetically sensitive input component 514*e* by stray fluxes Gc and Gd may adversely affect the performance of input component 514*e* (e.g., by destructive or constructive superposition of the stray flux densities). For example, a Hall Effect Sensor, which may use a magnet to flip a switch, can be either tripped prematurely or held in the tripped state if there is leakage flux present.

In order to reduce the effects of stray flux from adjacent loudspeaker input assemblies on any other magnetically sensitive device component, the two adjacent loudspeaker assemblies may be oriented in opposition magnetically. That is, a first loudspeaker assembly may be configured to be of the same acoustic phase as a proximal second loudspeaker assembly, but the first loudspeaker assembly may be configured to be of an opposite magnetic phase from the second loudspeaker assembly, such that the stray flux of each loudspeaker assembly may be guided into the magnetic flux of the other loudspeaker. This may redistribute flux away from any sensitive device disposed between the loudspeakers entirely, or may alter the direction of flux to a vector of lower sensitivity (e.g., as a sensitive component may only be sensitive to leakage in the −Z direction).

Figure 6:
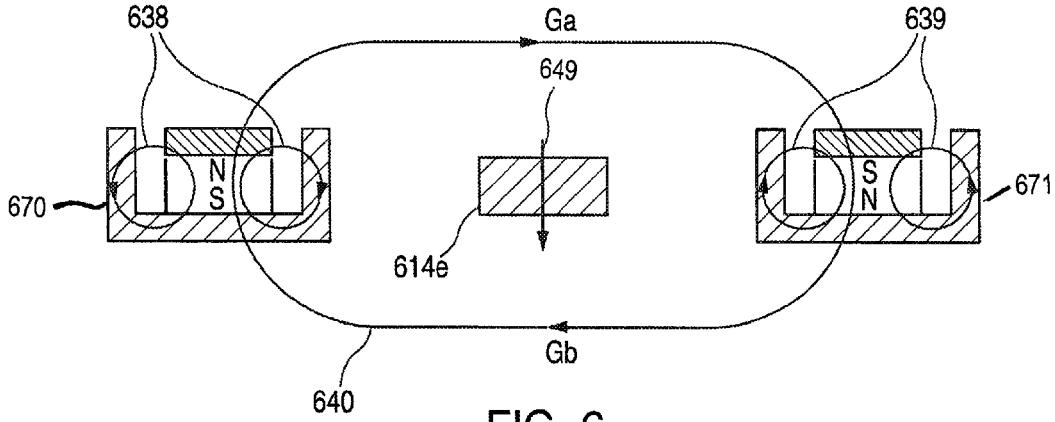
FIG. 6 shows a cross-sectional view of a different pair of magnet assemblies of corresponding loudspeakers, in accordance with at least one embodiment of the invention.

FIG. 6 shows a cross-sectional view of a pair of magnet assemblies 670 and 671 of corresponding loudspeakers (not shown) that can each be similar to magnet assemblies 270, 570, and 571. Rather than being oriented to produce magnetic flux paths in the same phase, however, magnet assemblies 670 and 671 can be oriented to produce opposite magnetic phases. As shown in FIG. 6, for example, magnet assembly 670 can be oriented to provide a magnetic flux path 638, whereas magnet assembly 671 can be oriented to provide an opposite magnetic flux path 639. Oriented in this manner, any magnetic flux that may stray from the flux paths may form a single closed flux loop. As shown in FIG. 6, for example, stray magnetic flux Ga and Gb may combine to form a single closed flux loop 640. Because flux loop 640 is guided away from the area between magnet assemblies 670 and 671, flux loop 640 does not interfere with magnetic flux of any component positioned between these magnet assemblies (e.g., a magnetically sensitive input device component 614*e* that may be similar to component 514*e*, and that may be positioned between magnet assemblies 670 and 671 in the same X-Y plane) and may have magnetic flux sensitivity direction 649.

Therefore, the effects of stray flux from adjacent loudspeaker input assemblies on another magnetically sensitive device component may be reduced by orienting the two adjacent loudspeaker assemblies in opposition magnetically. That is, a first loudspeaker assembly may be configured to be of the same acoustic phase as a proximal second loudspeaker assembly, but the first loudspeaker assembly may be configured to be of an opposite magnetic phase from the second loudspeaker assembly, such that the stray flux of each loudspeaker assembly may be guided into the magnetic flux of the other loudspeaker (e.g., as described with respect to FIG. 6). By inverting the electrical contacts (e.g., see contacts 498 of FIG. 4) of an audio source (e.g., see audio source 493 of FIG. 4) of a device (e.g., device 100) with the electrical contacts of the electromagnetic coil of one of the two loudspeaker assemblies of opposite magnetic phase, the acoustic phase of each assembly may be preserved. Alternatively, an audio source signal (e.g., see signal 496 of FIG. 4) may be inverted before being applied to one of the two loudspeaker assemblies. For example, as an alternative to inverting the electrical contact, a 180 degree inverter may invert the phase of the audio electrical signal being input. Alternatively, an amplifier or digital signal processing chain or audio source may do this before providing the signal to a loudspeaker input assembly. It is to be understood that an audio electrical signal may be filtered in one or more ways before being applied to each of the loudspeaker assemblies (e.g., loudspeaker assemblies 112*a* and 112*b*, or the pair of loudspeaker assemblies corresponding to magnet assemblies 670 and 671). For example, loudspeaker assembly 112*a* may be a tweeter loudspeaker and loudspeaker assembly 112*a* may be a woofer loudspeaker, and different frequency ranges of an audio electrical signal may be applied to different ones of loudspeaker assemblies 112*a* and 112*b*.

While there have been described systems and methods for reducing the effects of stray magnetic flux, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "top" and "bottom," "left" and "right," "length" and "width," "horizontal" and "vertical," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention.

Therefore, those skilled in the art will appreciate that the invention can be practiced by other than the described embodiments, which are presented for purposes of illustration rather than of limitation.

What is claimed is:

1. A handheld electronic device comprising:

one of a laptop computer, a tablet computer, or a cellular telephone that includes:

a first audio component configured to have a first acoustic phase and a first magnetic phase, a second audio component configured to have the first acoustic phase and a second magnetic phase that is opposite the first magnetic phase, the first audio component being positioned with respect to the second audio component such that stray magnetic flux from the first audio component enters the second audio component during operation of the first and second audio components, wherein the first audio component is a first loudspeaker having a first electrically conductive coil and the second audio component is a second loudspeaker having a second electrically conductive coil that provide the first acoustic phase, and a sensor of the handheld electronic device, the sensor responsive to stray magnetic flux of another component, the sensor disposed between the first audio component and the second audio component.

2. The electronic device of claim 1, wherein the first audio component is positioned adjacent the sensor, and the sensor is positioned adjacent the second audio component.

3. The electronic device of claim 1, wherein the sensor is: a hall effect sensor.

4. The electronic device of claim 1, wherein the first audio component comprises a first magnet being oriented to provide the first magnetic phase.

5. The electronic device of claim 4, wherein the first magnet is oriented to provide the first magnetic phase.

6. The electronic device of claim 5, wherein the second audio component comprises a second magnet being oriented to provide the second magnetic phase.

7. The electronic device of claim 6, wherein the second magnet is orient to provide the second magnetic phase.

8. The electronic device of claim 1, wherein the first audio component comprises a first coil former and the first electrically conductive coil, the first coil being wound around at least a portion of the first coil former.

9. The electronic device of claim 1, wherein the first audio component is positioned with respect to the second audio component such that the stray magnetic flux from the first audio component and stray magnetic flux from the second audio component form a single closed flux loop.

10. A method of manufacturing a handheld electronic device, the method comprising:

positioning a first audio component within the electronic device; the electronic device including one of a laptop computer, a tablet computer, or a cellular telephone; the first audio component being positioned to provide a first acoustic phase and a first magnetic phase;

situating a second audio component within the electronic device, the second audio component being situated to provide the first acoustic phase and a second magnetic phase opposite the first magnetic phase, and the first and second audio components being oriented relative to one another, such that the first and second magnetic phases cause stray magnetic flux from the first audio component to enter the second audio component during operation of the first and second audio components, wherein the first audio component is a first loudspeaker having a first electrically conductive coil and the second audio component is a second loudspeaker having a second electrically conductive coil to provide the first acoustic phase; and situating a sensor within the handheld electronic device, the sensor responsive to stray magnetic flux of another component, the sensor disposed between the first audio component and the second audio component.

11. The method of claim 10, wherein the positioning comprises orienting the first audio component such that a first magnet of the first audio component is in a first orientation.

12. The method of claim 10, wherein the situating the second audio component comprises orienting the second audio component such that a second magnet of the second audio component is in a second orientation opposite the first orientation.

13. The method of claim 10, wherein the first and second audio components are oriented relative to one another such that stray magnetic flux from the first audio component and stray magnetic flux from the second audio component form a single closed flux loop.

14. The method of claim 10, wherein the first and second audio components are oriented relative to one another such that the first and second magnetic phases cause stray magnetic flux from the second audio component to enter the first audio component during operation of the first and second audio components.

15. The electronic device of claim 1, wherein an audio source of the electronic device is connected to apply a first audio signal to the first electrically conductive coil and a second audio signal to the second electrically conductive coil to provide the first acoustic phase, and the second audio signal is an electrically inverted version of the first audio signal.

16. The electronic device of claim 15, wherein the second audio signal is electrically inverted by one of (1) electrically inverting second electrical contacts of the audio source as compared to first electrical contacts of the audio source, or (2) using one of an inverter, an amplifier, a digital signal processing chain, or the audio source of the electronic device to electrically invert the second audio signal as compared to the first audio signal.

17. The method of claim 10, further comprising:

connecting an audio source of the electronic device to apply a first audio signal to the first electrically conductive coil to provide the first acoustic phase, and to apply a second audio signal to the second electrically conductive coil to provide the first acoustic phase, wherein the second audio signal is an electrically inverted version of the first audio signal.

18. The method of claim 17, wherein the second audio signal is electrically inverted by one of (1) electrically inverting second electrical contacts of the audio source as compared to first electrical contacts of the audio source, or (2) using one of an inverter, an amplifier, a digital signal processing chain, or the audio source of the electronic device to electrically invert the second audio signal as compared to the first audio signal.

19. The electronic device of claim 1, wherein the sensor comprises one of a sensor that has its own magnetic flux, a sensor that is a magnetically sensitive input device component, or a sensor that may be affected by stray magnetic flux of another component.

20. The method of claim 10, wherein the sensor comprises one of a sensor that has its own magnetic flux, or a sensor that is a magnetically sensitive input device component.

* * * * *